United States Patent [19]

Glanton et al.

[11] Patent Number: 4,939,629

[45] Date of Patent: Jul. 3, 1990

[54] COMPACT LUMINAIRE INCLUDING A DOUBLE-ENDED LAMP

[75] Inventors: George G. Glanton, Edgefield, S.C.; Omer E. Murray, Hendersonville; Mitchell M. Osteen, Zirconia, both of N.C.

[73] Assignee: General Electric Company, Schenectady, N.Y.

[21] Appl. No.: 361,186

[22] Filed: Jun. 5, 1989

[51] Int. Cl.[5] ..... F21V 7/00

[52] U.S. Cl. ..... 362/223; 362/263; 362/307; 362/341

[58] Field of Search ..... 362/217, 218, 223, 263, 362/264, 294, 310, 341, 345, 296, 307

[56] References Cited

U.S. PATENT DOCUMENTS 3,911,265 10/1975 Landrum et al. ..... 362/296 X 4,755,711 7/1988 Fields et al. ..... 362/215 X

*Primary Examiner*—Stephen F. Husar

*Attorney, Agent, or Firm*—John P. McMahon; Stanley C. Corwin; Fred Jacob

[57] ABSTRACT

This luminaire comprises a metal housing surrounding an internal space and having a mouth at the front side of the housing. Within the housing is a double-ended lamp comprising a tube of transparent material and terminals at opposite ends of the tube. Also within the housing is a pair of sockets, each comprising contact structure for receiving one of the terminals and a ceramic support for supporting said contact structure. A ceramic reflector partially surrounds the tube. This ceramic reflector and the ceramic supports of the sockets constitute portions of a single integral ceramic piece that is adapted to be inserted through said mouth into said internal space as a single unit during assembly of the luminaire.

21 Claims, 3 Drawing Sheets

Fig. 1
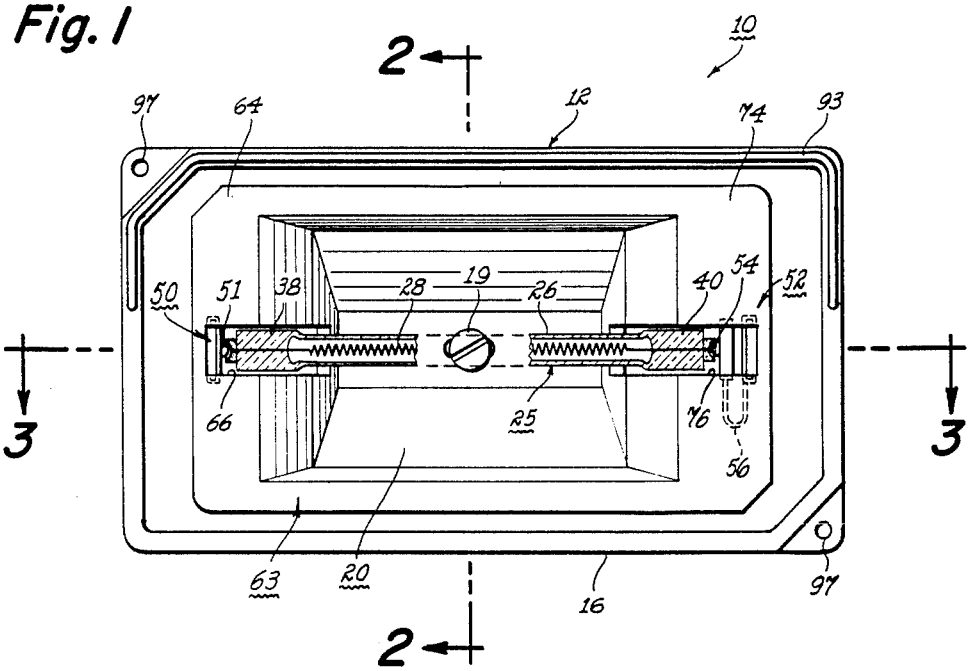
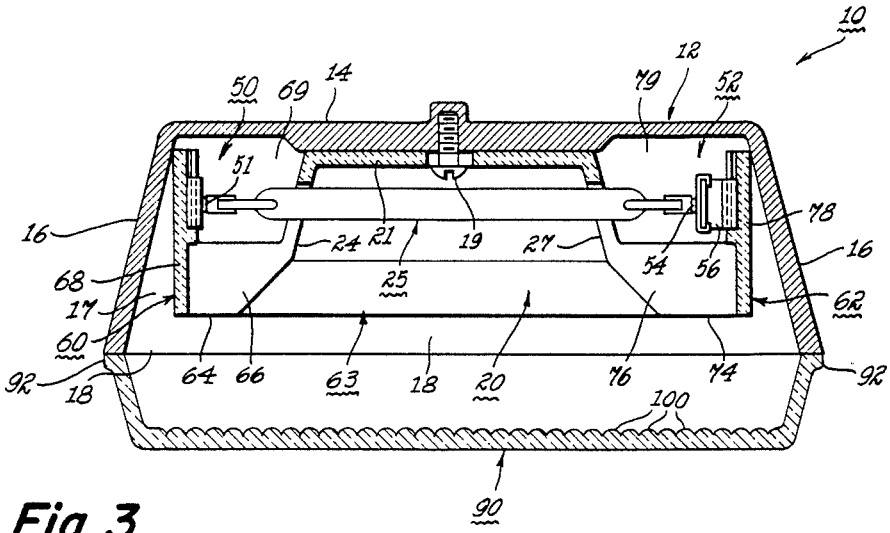
Fig. 3

Fig. 2
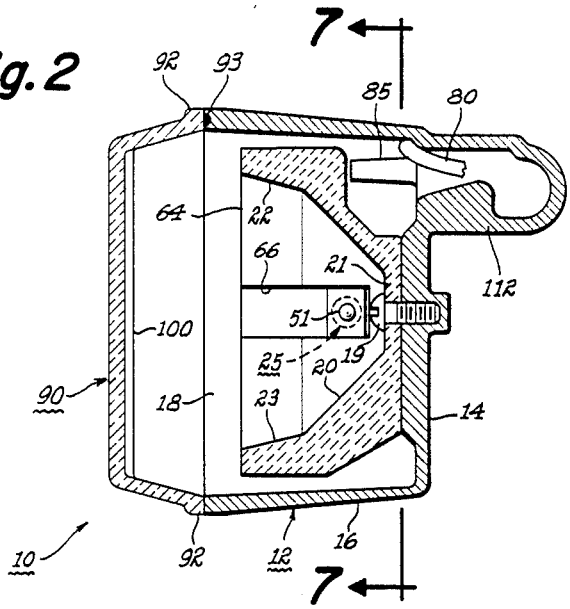
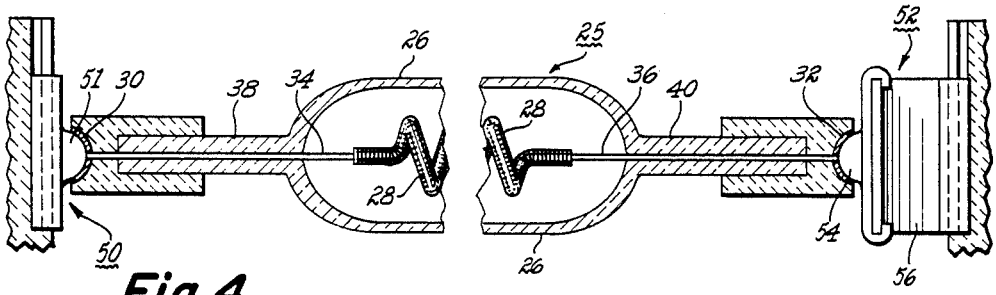
Fig. 4
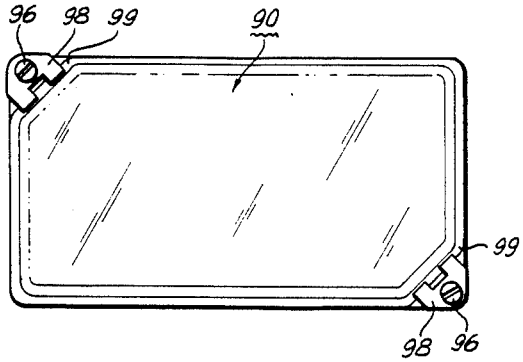
Fig. 5
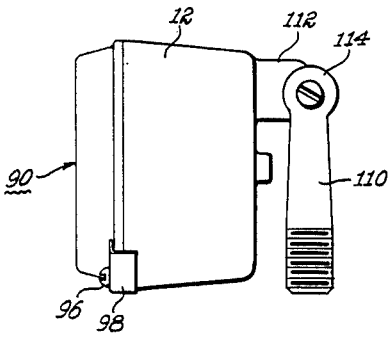
Fig. 6

Fig. 7
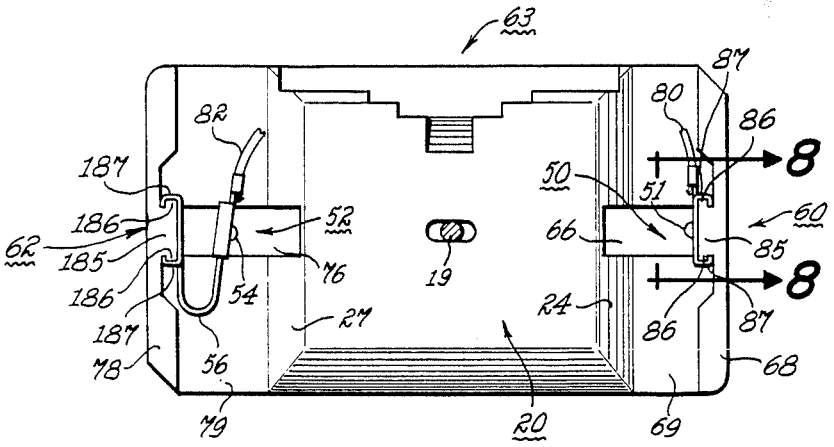
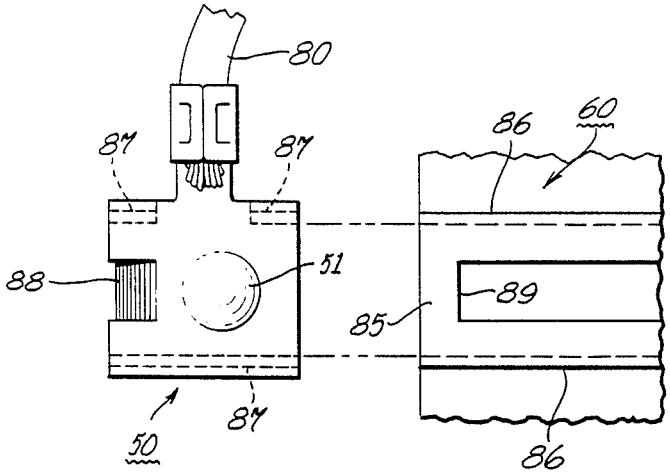
Fig. 8

COMPACT LUMINAIRE INCLUDING A DOUBLE-ENDED LAMP

This invention relates to a luminaire that comprises a double-ended lamp and, more particularly, to a luminaire of this type that is characterized by exceptional compactness and simplicity of construction.

BACKGROUND

The usual luminaire containing a double-ended lamp comprises a housing, typically of metal, and, within the housing, the following separate components in addition to the double-ended lamp: a sheet-metal reflector, means for mounting the reflector on the housing, contacts for making electrical contact with the lamp terminals, and ceramic receptacles that receive the contacts and mount the contacts on the metal housing and insulate them from the metal housing and the metal reflector. Because the number of parts is relatively great, the luminaire tends to be unduly complex, expensive, and large and to require excessive time and effort for its manufacture.

OBJECTS

An object of our invention is to provide a luminaire of the double-ended lamp type that is exceptionally simple and is characterized by having an exceptionally small number of parts that can be easily and quickly mounted within the luminaire housing.

Another object is to provide a luminaire of the double-ended lamp type that fulfills the immediately-preceding object and is also exceptionally compact.

Another object is to provide a luminaire of the double-ended lamp type that is simple in construction, exceptionally compact, and is able to readily withstand the high temperatures that inherently accompany its exceptional compactness.

SUMMARY

In carrying out the invention in one form, we provide a luminaire that includes a metal housing comprising a back wall and a hollow body projecting from the back wall and surrounding an internal space within the housing having a mouth at the front side of the housing. Within the housing is a double-ended lamp comprising a tube of transparent material, terminals at opposite ends of the tube, and means within the tube serving as a light source when traversed by current between said terminals. Also within the housing is a pair of sockets, each comprising contact structure for receiving one of the lamp terminals and a ceramic support for supporting said contact structure. A ceramic reflector partially surrounds said transparent tube in spaced relationship to the tube. The ceramic reflector and the ceramic supports of the sockets constitute portions of a single integral ceramic piece that is adapted to be inserted through said mouth into said internal space as a single unit during assembly of the luminaire. Making the reflector of ceramic and especially as a portion of a ceramic piece that integrally includes the contact supports results in a very compact and simple subassembly that can be easily and quickly incorporated into the luminaire. After insertion through the mouth of the housing, the subassembly is attached to the housing and a lens is placed over the mouth and is fixed to the housing.

BRIEF DESCRIPTION OF FIGURES

For a better understanding of the invention, reference may be had to the following detailed description taken in conjunction with the accompanying drawings, wherein:

FIG. 1 is a front elevational view of a luminaire embodying one form of the invention but shown without its lens and with its lamp shown partially broken away and in section.

FIG. 2 is a sectional view taken along the line 2—2 of FIG. 1, but with the lamp of FIG. 1 shown in phantom as a dotted-line circle.

FIG. 3 is a sectional view along the line 3—3 of FIG. 1, but showing the lamp in full.

FIG. 4 is an enlarged partially schematic sectional view, taken in the plane of FIG. 3, of the double-ended lamp used in the luminaire of FIGS. 1–3. Also shown in the figure are the contacts that engage the lamp terminals.

FIG. 5 is a front elevational view on a reduced scale of the luminaire of FIG. 1 and showing the lens of the luminaire clamped in place.

FIG. 6 is a side elevational view of the luminaire depicted in FIG. 5.

FIG. 7 is a rear view of the reflector and socket structure of the illustrated luminaire, as viewed along the line 7—7 of FIG. 2, but without the lamp.

FIG. 8 is a slightly enlarged detailed view of certain of the parts depicted in FIG. 7, i.e., contact structure and associated ceramic supporting structure, as viewed from the line 8—8 of FIG. 7, but showing these parts just prior to assembly.

DETAILED DESCRIPTION OF EMBODIMENT

Referring now to FIGS. 1–3, there is shown a luminaire 10 comprising a cup-shaped metal housing 12 having a back wall 14 and a hollow, generally rectangular body 16 projecting from the back wall toward the front of the luminaire. The hollow body 16 surrounds an internal space 17 within the luminaire and has one end open to define a mouth 18. In one form of the invention, the metal housing 12 is of die-cast aluminum.

Within the housing 12, there is located a reflector 20 of ceramic material that is generally concave with respect to the front of the luminaire. This reflector 20 is suitably fixed within the housing 12, for example, by a screw 19 extending through a central opening in the reflector and threaded into an aligned hole in the housing. As best seen in FIG. 2, the reflector includes a base 21 at its back side and portions 22 and 23 at its top and bottom projecting forwardly from the base. In addition, as best shown in FIG. 3, the reflector includes end portions 24 and 27 at its lateral edges projecting from base 21 in a flared, or divergent, relationship with respect to each other.

Also within the housing 12 is a double-ended lamp 25, a preferred form of which is a conventional halogen-cycle quartz lamp. Referring to FIG. 4, this lamp comprises a transparent quartz tube 26 within which is located a tungsten filament 28 of helical form extending axially of the tube and connected between a pair of conductive terminals 30 and 32 located at opposite ends of the tube. Lead-in wires 34, 36 at opposite ends of the tungsten filament pass through suitable seals 38, 40 that support the filament within tube 26 and seal the interior of the lamp from the surrounding space. Each lead-in wire 34 or 36 is connected at one end to an associated terminal 30 or 32 and at its opposite end to one end of the filament 28.

The tubular lamp 25 extends across the reflector, as seen in FIG. 3, and is partially surrounded by the reflector, as seen in FIG. 2. At opposite ends of the lamp 25, there are contact structures 50 and 52 for respectively engaging the lamp terminals and thus connecting them into an external circuit. Referring to FIGS. 3 and 4, the left-hand contact structures 50 comprise a hemispherically-shaped stationary contact 51 that fits within a mating recess in one of the lamp terminals 30. The other contact structure 52 comprises a movable hemispherically-shaped contact 54 that is spring-biased by a leaf spring 56 into engagement with a mating recess in the other lamp terminal 32.

Each of the contact structures 50 and 52 constitutes a portion of a socket for receiving one terminal of the lamp. Referring especially to FIG. 3, each socket further comprises a ceramic support for supporting the contact structure and for electrically insulating the contact structure from the metal housing 12. The left-hand ceramic support, as seen in FIG. 3, is designated 60 and the right-hand one is designated 62. In accordance with one form of our invention, these two ceramic supports 60 and 62 are integral with the ceramic reflector 20 so that the reflector and the ceramic supports taken together constitute a single integral ceramic piece 63.

In FIG. 3, the left-hand ceramic support 60 comprises a ceramic face 64 in front of the associated contact structure 50; and this face 64 has a slot 66 extending therethrough through which the left-hand end of the lamp 25 is passed when the lamp is being inserted into the luminaire from the front side of the luminaire. Slot 66 also extends into the end portion 24 of the reflector 20 so as to accommodate the left-hand end of the lamp 25 when the lamp is fully inserted. Referring still to FIG. 3, ceramic support 60 also comprises a flange 68 at the left-hand outer edge of the ceramic piece 63 that extends backwardly from the ceramic face 64 to form with the adjacent ceramic structure a recess 69 in which the contact structure 50 is located.

In FIG. 3, the right-hand ceramic support 62 is of generally the same configuration as the left-hand support 60. More specifically, the right-hand ceramic support 62 comprises a ceramic face 74 that has a slot 76 extending therethrough through which the right-hand end of the lamp 25 is passed when the lamp is being inserted into the luminaire from the front side of the luminaire. Slot 76 extends into the end portion 27 of the reflector 20 so as to accommodate the right-hand end of lamp 25 when the lamp is fully inserted. Ceramic support 62 further comprises a flange 78 at the right-hand outer edge of ceramic piece 63 that extends backwardly from ceramic face 74 to form with the adjacent ceramic structure a recess 79 in which the contact structure 52 is located. This recess is made somewhat larger than recess 69 to provide space for the leaf spring 56 that is used for biasing movable contact 54 into engagement with lamp terminal 32.

Referring to FIGS. 7 and 8, for supporting the right-hand contact structure 50 on the ceramic support 60, the support 60 is provided on its back side with an integral ceramic boss 85 having horizontally-extending upper and lower projections 86 at its free end. Contact structure 50 has fingers 87 that are adapted to partially embrace these projections 86. Referring to FIG. 8, the contact structures 50 can simply be slid onto boss 85 from the back side of the ceramic support 60, guided by the cooperating components 86 and 87. When the contact structure has thus been slid into the proper position against a stop, an inwardly projecting detent 88 on the contact structure snaps into place behind a shoulder 89 on the ceramic support, locking the contact structure in the desired position.

As also shown in FIG. 7, the other contact structure 52 is similarly supported on a ceramic boss (185) integral with and at the back side of the associated ceramic support 62. This boss 185 is shaped the same as the above-described boss 85, having horizontally-extending upper and lower projections 186 at its free end. The leaf spring 56 of contact structure 52 has fingers 187 that are adapted to partially embrace these projections 186. The leaf spring 56, having contact 54 suitably attached thereto, can simply be slid over the boss 185 from the back side of the ceramic support 62, guided by cooperating components 186 and 187. When the leaf spring has thus been slid into the proper position, it is locked in place by a detent on the spring snapping behind a shoulder on the ceramic. The detent and shoulder are the same as shown in FIG. 8, and the parts are slid together and locked in the same manner as described in the immediately-preceding paragraph.

It will be apparent from the two immediately-preceding paragraphs that each of the contact structures can be readily and quickly mounted and locked on its supporting ceramic by simply sliding the contact structure into its desired position and without requiring any separate fastening devices, especially separate fastening devices requiring insertion or manipulation.

Contact structures 50 and 52 are connected in an external circuit by insulated wires 80 and 82, respectively. Each of these wires is connected at one end to its associated contact structure by a suitable crimp connector. Each of these wires extends along the inner surface of the back wall 14 of metal housing 12 and exits the housing through a centrally located hole in this back wall. As seen in FIG. 2, the back wall includes integral shelf members 85 that project forwardly near the top of the housing body 16 thereby forming grooves in the housing for receiving the insulated wires. The insulated wires fit tightly in these grooves, thereby assuring that the wires will be held out of contact with the ceramic reflector 20, thus protecting them from the high temperatures of the ceramic housing. The metal housing 12, being exposed to the surrounding ambient and being a good heat conductor, operates at much lower temperatures than the ceramic housing.

As shown in FIG. 2, the luminaire includes at its front side a lens 90 that is outwardly dished with respect to the interior space of the luminaire. This lens 90 includes a peripheral flange portion 92 that is aligned at its rear end with the front end of the hollow body 16 of the metal housing 12. A suitable gasket 93 is disposed between the aligned end surfaces of parts 16 and 92 and serves when these parts are clamped together to provide a leak-proof joint between them.

The lens 90 is clamped to the metal housing 12 by suitable fastening means, best shown in FIG. 5. This fastening means comprises screws 96 threaded into holes 97 (FIG. 1) in two corners of the metal housing 12. Beneath the head of each screw is a clip 98 that fits over a corner flange portion 99 on the lens so that when the screws are tightened, the lens is clamped against the housing.

The lens 90 is preferably made of molded borosilicate glass. Such glass has a much higher softening temperature than the soda lime flat sheet glass that has typically been used in prior art luminaires of this type, and this allows for higher operating temperatures than permissible with such prior-art luminaires. The use of molded glass also enables us to easily form refractors in the internal surface of the lens, such formation being effected during the molding process with a suitably shaped die. These refractors, which may take any suitable form, such as the flutes 100 of FIGS. 2 and 3, facilitate improved control of the light output from the luminaire.

When the lamp 25 is energized, most of the light emitted by its incadescent filament 28 is projected onto the ceramic reflector 20, and the reflector reflects this light in a direction generally forwardly of the luminaire and through the lens 90. The refractors 100 on the lens act to distribute this light in the desired pattern. The reflector 20, though made of ceramic rather than the usual metal, has a high degree of reflectance and is capable of reflecting about 90 percent of the incident light, most of it in a diffuse state. In a preferred form of the invention, a glaze is provided over the entire front of the ceramic piece 63, including the active surface of the reflector 20 and the front surface of the faces 64 and 74. This glaze facilitates cleaning of these surfaces to maintain their reflectance. In a preferred form of the invention, the material of the ceramic piece 63 is a ceramic made of white China clay and the glaze is a transparent vitreous enamel. Although we prefer to include a glaze as a part of the ceramic piece 63, our invention in its broader aspects includes use of an unglazed ceramic, provided the ceramic has good reflecting properties, as is the case with the ceramic of white China clay.

The fact that our reflector 20 and our contact supports 60 and 62 of the sockets are made as a single ceramic piece (63) enables us to provide a very compact and simple construction. There is no need for separate insulators for electrically insulating the contacts from the reflector or from the metal housing or for separate support means for the sockets. It is a simple matter to assemble the contact structures 50 and 52 onto the ceramic support 63 while still outside the casing 12 and then to drop this subassembly into the casing 12, thereafter fastening it in place with the single screw 19. The conductors 80 and 82 are also incorporated in this subassembly before it is mounted in the housing 12, and the wires are positioned in the grooves 85 as part of this mounting operation.

The lamp 25 is installed after the reflector and sockets are mounted as above described. This is done simply by inserting the lamp horizontally as depicted in FIGS. 1 and 2, causing its ends to enter the slots 66 and 76 and to seat on the contacts 51 and 54 of the sockets.

For blocking access to the contact structures 50 and 52 except through the slots 66 and 76, the faces 64 and 74 of the ceramic piece 63 are extended vertically, as seen in FIG. 1, for substantial distances on opposite sides of the slots 66 and 76. This reduces the possibility of unintentional exposure to these contact structures. In addition, the vertically-extending faces 64 and 74 serve to give the luminaire a neat, finished look and also provide reflecting surfaces on their front to again reflect any light that might be reflected from the lens 90.

FIG. 6 illustrates a suitable supporting arrangement for the luminaire of FIGS. 1–5. This supporting arrangement comprises a stem 110 connected to a projecting lug 112 on the rear side of housing 12 by means of a suitable swivel joint 114. These parts are preferably made hollow so that they can serve as a conduit for carrying wires 81 and 82 to the interior space 17 within the housing 12.

While we have shown and described a particular embodiment of our invention, it will be apparent to those skilled in the art that various changes and modifications may be made without departing from our invention in its broader aspects; and we, therefore, intend in the appended claims to cover all such changes and modifications as fall within the true spirit and scope of our invention.

What we claim as new and desire to secure by Letters Patent of the United States is:

1. A luminaire comprising:

(a) a metal housing comprising a back wall and a hollow body projecting from said back wall and surrounding an internal space within said housing having a mouth at the front side of the housing, (b) a double-ended lamp within said housing comprising a tube of transparent material, terminals at opposite ends of the tube, and means within said tube for serving as a light source when traversed by current between said terminals, (c) a pair of spaced-apart sockets within said housing each comprising contact structure for receiving one of said terminals and a ceramic support for supporting said contact structure, (d) a ceramic reflector partially surrounding said transparent tube, the ceramic reflector and the ceramic supports of said sockets constituting portions of a single integral ceramic piece that is adapted to be inserted through said mouth into said housing as a single unit during assembly of the luminaire, (e) means for attaching said integral ceramic piece to said housing after insertion thereof through said mouth, (f) a lens, and (g) means for attaching said lens to said housing in a position covering said mouth.

2. The luminaire of claim 1 in which said lens is dished outwardly with respect to said internal space so as to generally surround said mouth.

3. The luminaire of claim 1 in which said integral ceramic piece comprises at opposite sides of said reflector and in front of said lamp terminals two faces having front surfaces respectively facing toward said lens, each of said faces having a slot therein through which one of said terminals is adapted to pass when the lamp is being inserted into or removed from said luminaire.

4. The luminaire of claim 3 in which each of said contact structures is located behind one of said faces and is accessible for engagement with its associated terminal structure when the terminal structure is inserted through said slot during lamp insertion.

5. The luminaire of claim 4 in which each of said faces extends for substantial distances on opposite sides of said slot and is positioned to block access to an associated contact structure except through said slot.

6. The luminaire of claim 1 in which:

(a) said integral ceramic piece includes ceramic flanges at its opposite edges located laterally outward of said lamp terminals and extending backwardly away from said front faces, and (b) each of said contact structures is located between one of said flanges and a terminal of the lamp.

7. The luminaire of claim 3 in which:
(a) said integral ceramic piece includes ceramic flanges at its opposite edges located laterally outward of said lamp terminals and extending backwardly away from said front faces, and
(b) each of said contact structures is located between one of said flanges and a terminal of the lamp.

8. The luminaire of claim 3 in which said reflector includes a ceramic base adjacent said back wall of the housing and ceramic end portions projecting from said base toward said lens, each of said slots extending into one of said end portions so as to accommodate one end of the lamp when the lamp is fully inserted into a position where its terminals are received by said contact structures.

9. The luminaire of claim 1 in which said reflector includes a ceramic base adjacent said back wall of the housing and ceramic end portions projecting from said base toward said lens, and in which slots are included in said end portions so as to receive therein one end of the lamp when the lamp is fully inserted into a position where its terminals are received by said contact structures.

10. The luminaire of claim 1 in which:
(a) each of said contact structures constitutes a first part,
(b) the associated ceramic support constitutes a second part,
(c) said two parts include means for enabling one of said parts to be slid onto the other, and
(d) locking means is provided for locking said two parts together after said sliding.

11. In a luminaire comprising a metal housing comprising a back wall and a hollow body projecting from said back wall and surrounding an internal space having a mouth at the front side of the housing, the housing being adapted to receive a double-ended lamp comprising (i) a tube of transparent material, (ii) terminals at opposite ends of the tube, and (iii) means within said tube for serving as a light source when traversed by current between said terminals, said luminaire further comprising:
(a) a pair of spaced-apart sockets within said housing, each socket comprising: (i) contact structure for receiving one of said lamp terminals and (ii) a ceramic support for supporting said contact structure,
(b) a ceramic reflector within said housing adapted to partially surround said transparent tube, the ceramic reflector and the ceramic supports of said sockets constituting portions of a single integral ceramic piece that is adapted to be inserted through said mouth into said housing as a single unit during assembly of the luminaire,
(c) means for attaching said integral ceramic piece to said housing after insertion thereof through said mouth,
(d) a lens, and
(e) means for attaching said lens to said housing in a position covering said mouth.

12. The luminaire of claim 11 in which said lens is dished outwardly with respect to said internal space so as to generally surround said mouth.

13. The luminaire of claim 11 in which said integral ceramic piece comprises at opposite sides of said reflector and in front of said contact structures two faces having front surfaces respectively facing toward said lens, each of said faces having a slot therein through which one of said terminals is adapted to pass when the lamp is being inserted into or removed from said luminaire.

14. The luminaire of claim 13 in which each of said contact structures is located behind one of said faces and is accessible for engagement with its associated terminal structure when the terminal structure is inserted through said slot during lamp insertion.

15. The luminaire of claim 14 in which each of said faces extends for substantial distances on opposite sides of said slot and is positioned to block access to an associated contact structure except through said slot.

16. The luminaire of claim 11 in which:
(a) said integral ceramic piece includes ceramic flanges at its opposite edges located laterally outward of said contact structures and extending backwardly away from said front faces, and
(b) each of said contact structures is located between one of said flanges and the position occupied by a terminal of the lamp when the lamp is received by said contact structure.

17. The luminaire of claim 13 in which:
(a) said integral ceramic piece includes ceramic flanges at its opposite edges located laterally outward of said contact structures and extending backwardly away from said front faces, and
(b) each of said contact structures is located between one of said flanges and the position occupied by a terminal of the lamp when the lamp is received by said contact structure.

18. The luminaire of claim 13 in which said reflector includes a base adjacent said back wall of the housing and end portions projecting from said base toward said lens, each of said slots extending into one of said end portions so as to accommodate one end of the lamp when the lamp is fully inserted into a position where its terminals are received by said contact structures.

19. The luminaire of claim 11 in which said reflector includes a base adjacent said back wall of the housing and end portions projecting from said base toward said lens, and in which slots are included in said end portions so as to receive therein opposite ends of the lamp when the lamp is fully inserted into a position where its terminals are received by said contact structures.

20. The luminaire of claim 11 in which:
(a) each of said contact structures constitutes a first part,
(b) the associated ceramic support constitutes a second part,
(c) said two parts include means for enabling one of said parts to be slid onto the other, and
(d) locking means is provided for locking said two parts together after said sliding.

21. A luminaire comprising:
(a) a metal housing comprising a back wall and a hollow body projecting from said back wall and surrounding an internal space within said housing having a mouth at the front side of the housing,
(b) a double-ended lamp within said housing comprising a tube of transparent material, terminals at opposite ends of the tube, and means within said tube for serving as a light source when traversed by current between said terminals,
(c) a pair of spaced-apart sockets within said housing each comprising contact structure for receiving one of said terminals and a ceramic support for supporting said contact structure, (d) a ceramic reflector partially surrounding said transparent tube, the ceramic support of each socket being integral with a portion of said ceramic reflector so that said support and said reflector portion form a unit that is insertable through said mouth into said housing, (e) means for attaching said unit to said housing after insertion thereof through said mouth, (f) a lens, and (g) means for attaching said lens to said housing in a position covering said mouth.

* * * * *